US008109275B2

(12) United States Patent
Bao

(10) Patent No.: US 8,109,275 B2
(45) Date of Patent: Feb. 7, 2012

(54) COMBINATION SMOKING DEVICE AND LIGHTER

(76) Inventor: Fan Bao, City of Industry, CA (US)

( * ) Notice: Subject to any disclaimer, the term of this patent is extended or adjusted under 35 U.S.C. 154(b) by 64 days.

(21) Appl. No.: 12/291,809

(22) Filed: Nov. 12, 2008

(65) Prior Publication Data

US 2010/0116280 A1 May 13, 2010

(51) Int. Cl.
*A24F 3/00* (2006.01)

(52) U.S. Cl. ..... 131/185

(58) Field of Classification Search ..... 131/185
See application file for complete search history.

(56) References Cited

U.S. PATENT DOCUMENTS

| | | | | |
|---|---|---|---|---|
| 2,543,798 | A * | 3/1951 | Paige | 431/252 |
| 4,223,687 | A * | 9/1980 | Sandeen | 131/180 |
| 5,456,269 | A * | 10/1995 | Kollasch | 131/330 |
| 5,848,596 | A * | 12/1998 | Zelenik | 131/329 |
| 7,694,685 | B1 * | 4/2010 | Jones | 131/185 |
| 2008/0050685 | A1 * | 2/2008 | Bao et al. | 431/153 |

* cited by examiner

*Primary Examiner* — Richard Crispino
*Assistant Examiner* — Dionne Walls Mayes
(74) *Attorney, Agent, or Firm* — Raymond Y. Chan; David and Raymond Patent Firm

(57) ABSTRACT

A pipe lighter includes a lighter apparatus coupling with an inhaler apparatus. The inhaler apparatus includes a crucible unit coupled with the housing sidewall of the lighter housing and a tubular inhaling guider extended from the crucible unit, wherein the crucible unit has a substance chamber positioned adjacent to a flame opening of the lighter apparatus for retaining a smoking substance in the substance chamber, such that the lighter apparatus is actuated to produce a flame for a combustion of the smoking substance to be smoked and for an inhalation of smoked through the inhaling guider.

14 Claims, 4 Drawing Sheets

COMBINATION SMOKING DEVICE AND LIGHTER

BACKGROUND OF THE PRESENT INVENTION

1. Field of Invention

The present invention relates to a lighter, and more particularly to a pipe lighter which comprises a lighter apparatus equipped with an inhaler apparatus to form a single portable apparatus for enhancing the practice use of the inhaler apparatus.

2. Description of Related Arts

A pipe is a common tool for tobacco smoking and typically consists of a small chamber for the combustion of tobacco. Generally, the pipe is commonly made of briar, corncob, meerschaum, and clay. People who want smoking usually carry a lighter to ignite the tobacco inside the pipe. However, no matter which type of pipe it is, the smokers must carry the lighter or other lighting tool in order to ignite the tobacco. Accordingly, how to carry the smoking substance is another issue. Therefore, the smokers must need to bring a lot of smoking tools at the same time and this causes inconvenience for people who smoke.

On the other hand, the smokers usually have the experience of borrowing other people's lighter to ignite the tobacco. Even though the smoker may have the lighter and the pipe on hand, it is not guaranteed that the user can be able to directly aim the flame at the smoking substance. In other words, it is not easy for people to ignite the tobacco in outdoor environment, especially in a windy condition.

Moreover, cleaning the pipe after smoking is a big issue for maximizing and extending the life span of the pipe. Some people use a pipe tool to clean out the ash and unburned tobacco. However, for some small pipes or long channel pipes, it is hard for people to clean the ash and the last bits out by using a pipe tool.

If the unburned tobacco and the ash doesn't come out during last clean, the flavor of the cigarette or the tobacco dramatically ruined by the residue element. Finally, the smokers usually require a tool for adjusting, packing and emptying the tobacco inside the pipe, and a regular supply of pipe cleaners. The size of the pipe and the tool for cleaning pipe are usually bulky, and hard for people to carry them on hand.

SUMMARY OF THE PRESENT INVENTION

A main object of the present invention is to provide a pipe lighter, which comprises a lighter apparatus equipped with an inhaler apparatus to form a single portable apparatus for enhancing the practice use of the inhaler apparatus.

Another object of the present invention is to provide a pipe lighter, wherein the flame opening of the lighter apparatus is positioned adjacent to the substance chamber of the inhaler apparatus, in such a manner that when the lighter apparatus is actuated to produce the flame at the flame opening, the smoking substance is instantly burnt so as to allow the smoker to smoke via the inhaler apparatus.

Another object of the present invention is to provide a pipe lighter, wherein the inhaler apparatus is pivotally coupled with the lighter apparatus such that the pipe lighter is adapted to fold at a compact folded position for enhancing the portability of the pipe lighter and is adapted to fold at an unfolded position for the smoker to smoke right the way.

Another object of the present invention is to provide a pipe lighter, wherein the flame opening of the lighter apparatus is enclosed by the inhaler apparatus when the pipe lighter is folded at the folded position so as to prevent the lighter apparatus from being actuated accidentally.

Another object of the present invention is to provide a pipe lighter, which provides a substance compartment at a side housing for containing the smoking substance such that the smoker is able to carry extra smoking substance in hand.

Another object of the present invention is to provide a pipe lighter, wherein the inhaler apparatus can be precisely folded between the folded position and the unfolded position because the side housing provides two folding guides for limiting a pivotal movement of the inhaler apparatus.

Another object of the present invention is to provide a pipe lighter, wherein the side housing has a trapezoid shape such that the side housing is designed for the smoker to easily access the substance compartment for depositing or withdrawing the smoking substance thereat.

Another object of the present invention is to provide a pipe lighter, wherein the lighter housing further has a plurality of ventilating holes spacedly formed on the housing sidewall of the lighter housing to maintain continuity of enough fresh air supplies and to prevent the heat accumulating within the lighter housing.

Another object of the present invention is to provide a pipe lighter, wherein the inhaling guilder is detachable, such that the user is able to easily clean the inhaling guilder.

Another object of the present invention is to provide a pipe lighter, wherein the pipe lighter provides a piezoelectric-type lighter such that the user is able to lighten the smoking tool in outdoor windy condition.

Accordingly, in order to accomplish the above objects, the present invention provides a pipe lighter comprising a lighter apparatus and an inhaler apparatus coupling with the lighter apparatus.

The lighter apparatus comprises a lighter housing having a housing sidewall, a flame opening provided at the housing sidewall, and a fuel storage chamber for storing liquefied gas therewithin, an ignition unit supported within the lighter housing, a flame nozzle operatively extended from the fuel storage chamber to the flame opening for releasing the gas in a controllable manner, and an actuator which is movably supported on the lighter housing and is arranged in such a manner that when the actuator is depressed, the gas in the fuel storage chamber is released towards the flame nozzle while the ignition unit is activated for igniting the gas at the flame nozzle so as to produce a flame through the flame opening.

The inhaler apparatus comprises a crucible unit coupled with the housing sidewall of the lighter housing and a tubular inhaling guider extended from the crucible unit, wherein the crucible unit has a substance chamber positioned adjacent to the flame opening of the lighter housing for retaining a smoking substance in the substance chamber, such that the lighter apparatus is actuated to produce a flame for a combustion of the smoking substance to be smoked and for an inhalation of smoked through the inhaling guider.

These and other objectives, features, and advantages of the present invention will become apparent from the following detailed description, the accompanying drawings, and the appended claims.

DETAILED DESCRIPTION OF THE PREFERRED EMBODIMENT

Figure 1:
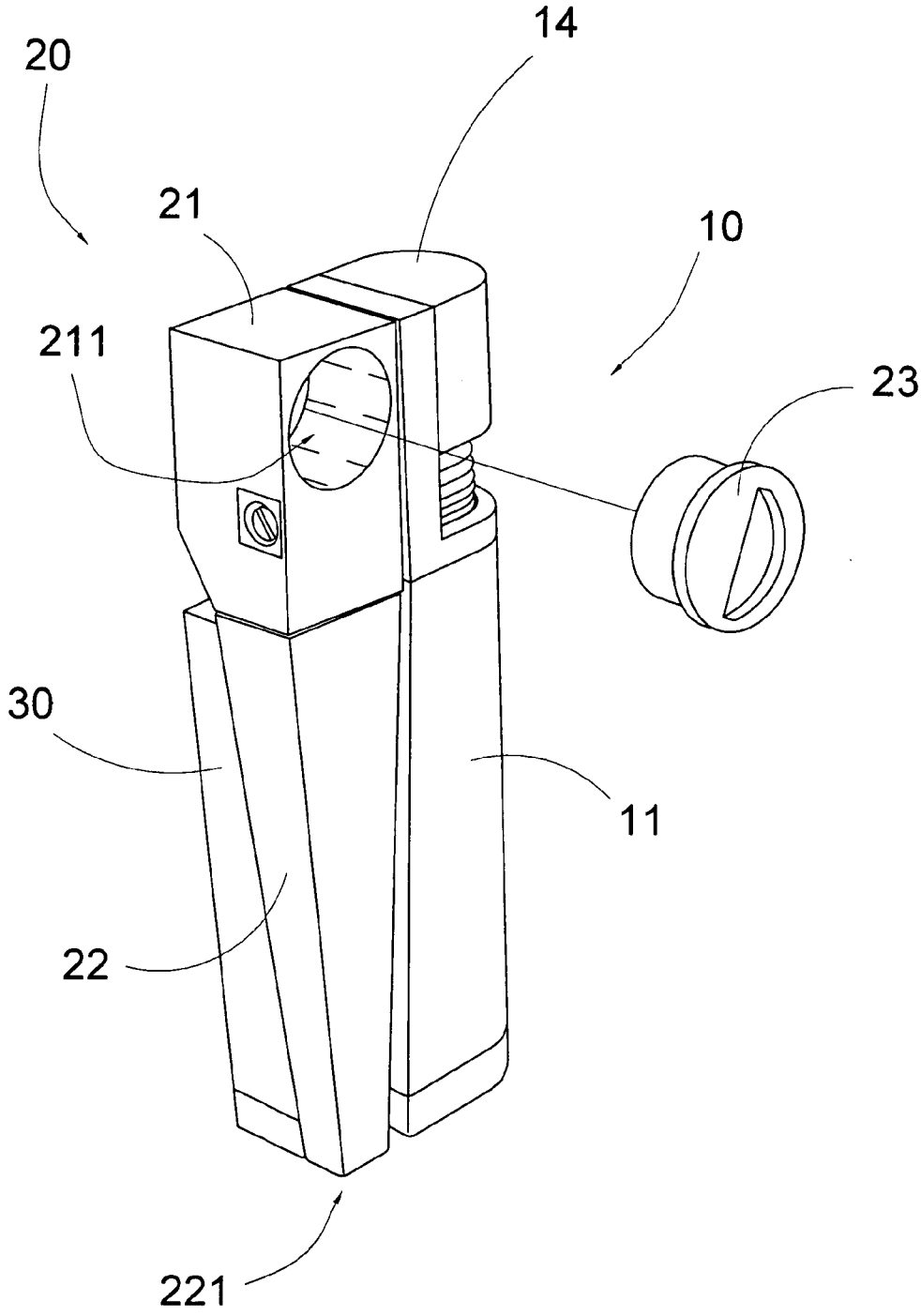
FIG. 1 is a perspective view of a pipe lighter according to a preferred embodiment of the present invention, illustrating the pipe lighter being folded at a folded position.
Figure 2:
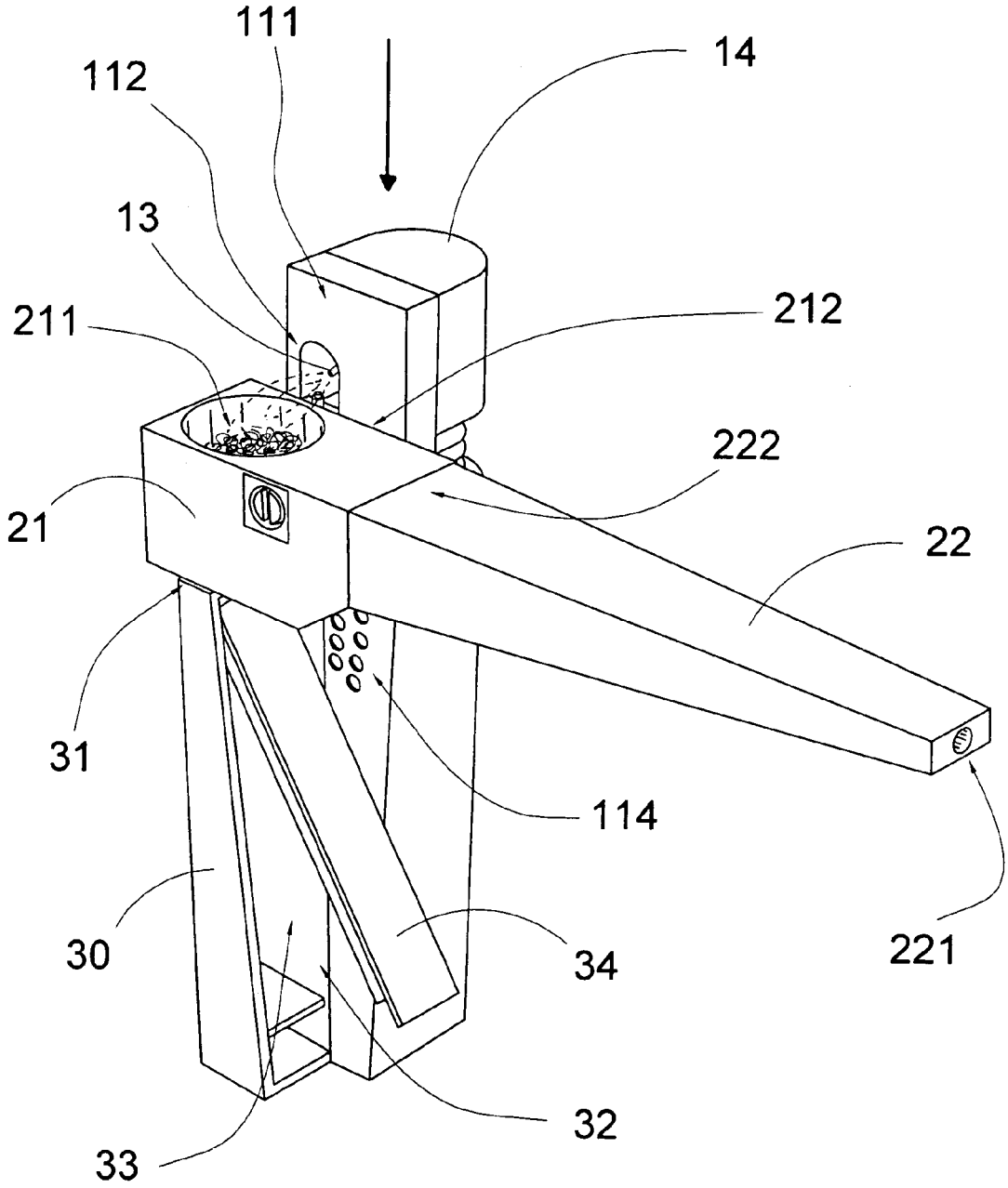
FIG. 2 is a perspective view of the pipe lighter according to the above preferred embodiment, illustrating the pipe lighter being folded at an unfolded position.

Referring to FIGS. 1 to 2 of the drawings, a pipe lighter according to a preferred embodiment of the present invention is illustrated, wherein the pipe lighter comprises a lighter apparatus 10 and an inhaler apparatus 20 coupling with the lighter apparatus 10.

The lighter apparatus 10 comprises a lighter housing 11 having a housing sidewall 111, a flame opening 112 provided at the housing sidewall 111, and a fuel storage chamber 113 for storing liquefied gas therewithin.

The lighter apparatus 10 further comprises an ignition unit 12 supported within the lighter housing 11, a flame nozzle 13 operatively extended from the fuel storage chamber 113 to the flame opening 112 for releasing the gas in a controllable manner, and an actuator 14 which is movably supported on the lighter housing 11 and is arranged in such a manner that when the actuator 14 is depressed, the gas in the fuel storage chamber 113 is released towards the flame nozzle 13 while the ignition unit 12 is activated for igniting the gas at the flame nozzle 13 so as to produce a flame through the flame opening 112.

The inhaler apparatus 20 comprises a crucible unit 21 coupled with the housing sidewall 111 of the lighter housing 11 and a tubular inhaling guider 22 extended from the crucible unit 21, wherein the crucible unit 21 has a substance chamber 211 positioned adjacent to the flame opening 112 of the lighter housing 11 for retaining a smoking substance in the substance chamber 211.

Accordingly, the lighter apparatus 10 is actuated to produce the flame for a combustion of the smoking substance to be smoked and for an inhalation of smoked through the inhaling guider 22.

According to the preferred embodiment, the lighter apparatus 10, which is embodied as a convention lighter, to enhance the operation of the lighter apparatus 10.

Figure 3:
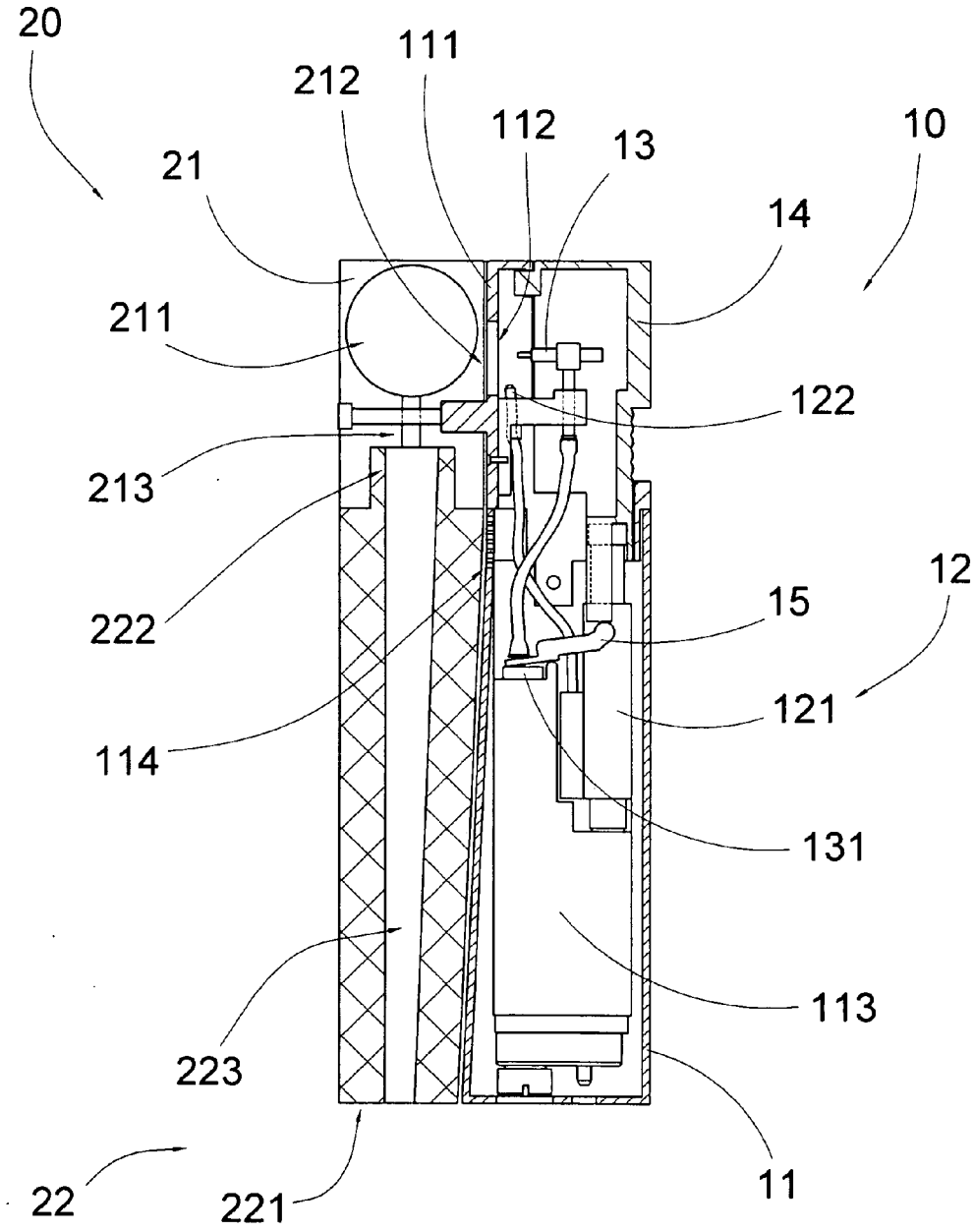
FIG. 3 is a top sectional view of the pipe lighter according to the above preferred embodiment of the present invention, illustrating the structural relationship between the lighter apparatus and the inhaler apparatus.

The ignition system 12, as shown in FIG. 3, is a sparks producing device which comprises a piezoelectric unit 121 supported within the lighter housing 11 for generating piezoelectricity, and an ignition tip 122 extended to a position closed to the flame nozzle 13. When the actuator 14 is actuated to press at the piezoelectric unit 121, sparks are generated at the ignition tip 122 to ignite the gas emitted from the flame nozzle 13 to produce the flame.

It is appreciated that the ignition system 12 can be a flint type ignition system wherein the spark can be produced via a flint and a striker wheel supported on the lighter housing 11.

The flame nozzle 13 is operatively extended from the fuel storage chamber 113 via a gas releasable valve 131, wherein a gas lever 15 is pivotally supported in the lighter housing 11 to engage with the gas releasable valve 131 and arranged in such a manner that when the actuator 14 is actuated to press at one end of the gas lever 15, the gas lever 15 is pivotally moved to open the gas releasable valve 131 for releasing the gas from the fuel storage chamber 113 to the flame nozzle 13. In other words, when the actuator 13 is actuated, the ignition system 12 is actuated to produce the spark while the gas releasable valve is actuated to release the gas at the same time to produce the flame at the flame nozzle 13 through the flame opening 112.

The actuator 14 is slidably mounted on the lighter housing 11 and is attached to a top end of the ignition system 12, wherein the actuator 14 is embodied as a pusher button for the smoker to depress so as to complete the ignition operation of the lighter apparatus 10. Preferably, the lighter apparatus produces the visible flame. Alternatively, the lighter apparatus can produce a windproof flame such as torch flame when the flame nozzle 13 is a torch nozzle.

Figure 4:
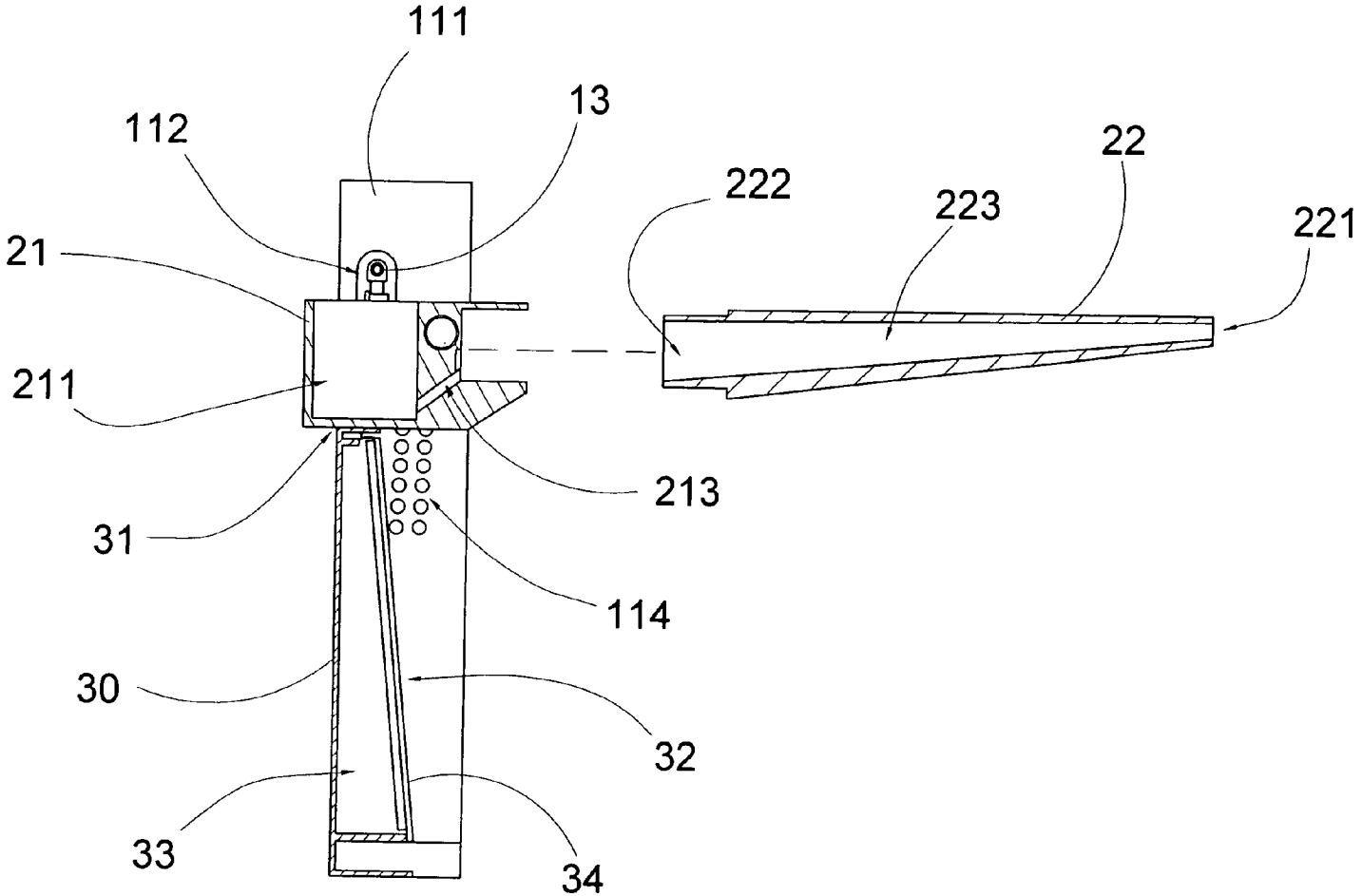
FIG. 4 is a side sectional view of the pipe lighter according to the above preferred embodiment of the present invention, illustrating the structural configuration between the flame opening and the substance chamber.

As shown in FIGS. 2 and 4, the lighter housing 11 further has a plurality of ventilating holes 114 spacedly formed on the housing sidewall 111 of the lighter housing 11 to communicate with an interior thereof for enhancing an air circulation of the lighter housing 11 when the lighter apparatus 10 is actuated for ignition. In addition, the ventilating holes 114 are adapted to maintain continuity of enough fresh air supplies and to prevent the heat accumulating within the lighter housing 11.

As shown in FIGS. 1 and 2, the inhaler apparatus 20 is foldably coupled with the lighter apparatus 10. In particularly, the crucible unit 21 has a coupling sidewall 212 pivotally coupling with the housing sidewall 111 of the lighter housing 11 such that the inhaler apparatus 20 is adapted to pivotally move between a folded position, as shown in FIG. 1, and an unfolded position, as shown in FIG. 2.

Accordingly, at the folded position, the inhaler apparatus 20 is pivotally folded to parallely extend from and aside the lighter apparatus 10 to overlap the coupling sidewall 212 of the crucible unit 21 with the housing sidewall 111 of the lighter housing 11 so as to form a compact box-shaped structure. Since the coupling sidewall 212 of the crucible unit 21 is overlapped with the housing sidewall 111 of the lighter housing 11, the flame opening 112 is covered by the coupling sidewall 211 of the crucible unit 21 for preventing the flame being produced at the flame opening 112.

At the unfolded position, the inhaler apparatus 20 is perpendicularly extended from and aside the lighter apparatus 10. Accordingly, when the inhaler apparatus 20 is folded at the unfolded position, the crucible unit 21 is pivotally folded until the substance chamber 211 thereof is positioned adjacent to the flame opening 112 of the lighter housing 11. Therefore, the smoker is able to actuate the actuator 13 of the lighter apparatus 10 to produce the flame at the flame opening 112 and to burn the smoking substance in the substance chamber 211.

The inhaling guider 22 has a mouth-piece end 221, an opposed coupling end 222 coupling with the crucible unit 21, and an inhaler channel 223 extended from the coupling end 222 to the mouth-piece end 221 to communicate with the substance chamber 211 for an inhalation of the smoked through the inhaling guider 22. Once the smoking substance in the substance chamber 211 is burnt, the smoker is able to inhale the smoke through the inhaling guider 22. As shown FIG. 4, the crucible unit 21 further comprises a communication slot 213 extended from the substance chamber 211 to communicate with the coupling end 222 of the inhaling guider 22 such that the smoke at the substance chamber 211 is guided to flow to the inhaling guider 22 through the communication slot 213.

Preferably, the coupling end 222 of the inhaling guider 22 is detachably coupled with the crucible unit 21 such that the smoker is able to detach the inhaling guider 22 from the crucible unit 21 for cleaning purpose.

As shown in FIGS. 1, 2 and 4, the pipe lighter further comprises a side housing 30 sidewardly and integrally extended from the housing sidewall 111 of said lighter housing 11, wherein the side housing 30 has a top wall 31 and a front wall 32 arranged in such a manner that when the inhaler apparatus 20 is pivotally folded at the folded position, the inhaling guider 22 is folded to overlay on the front wall 32 of the side housing 30, and when the inhaler apparatus 20 is pivotally folded at the unfolded position, the crucible unit 21 is folded to overlay on the top wall 31 of the side housing 30. Therefore, the front wall 32 and the top wall 31 of the side housing 30 form as two folding guides for limiting a pivotal movement of the inhaling apparatus 20 between the folded and unfolded positions. In other words, the smoker is able to precisely fold the inhaler apparatus 20 between the folded position to ensure the flame opening 112 being covered by the crucible unit 21 and the unfolded position to ensure the substance chamber 211 being positioned adjacent to the flame opening 112 of the lighter housing 11.

As shown in FIGS. 2 and 4, the side housing 30 further has a substance compartment 33 formed at the front wall 32 for containing extra smoking substance to be smoked, and comprises a compartment cover 34 pivotally coupled at the front wall 32 to pivotally enclose the substance compartment 33. In other words, the compartment cover 34 becomes part of the front wall 32. It is worth to mention that in order to open the compartment cover 34, the inhaler apparatus 20 must be folded at the unfolded position. At the folded position, the compartment cover 34 is covered by the inhaler apparatus 20 to prevent the substance compartment 33 being accessed unintentionally.

As shown in FIG. 4, the side housing 30 has a trapezoid shape that a cross-sectional area of the substance compartment 33 is gradually reducing towards the top wall 31. Therefore, the smoker can easily open or close the compartment cover 34 to access the substance compartment 33 for depositing or withdraw the smoking substance therein. In particularly, the thickness of lighter housing 11, which is equal to the thickness of crucible unit 21, is also equal to the total thickness of inhaling guilder 22 and the side housing 22 as well. Thus, the thickness is consistent throughout, streamlining the shape. The inhaling guilder 22 and the substance compartment 33 are slightly tapered in order to facilitate use.

In order to use the pipe lighter of the present invention, the smoker is able to fold the inhaler apparatus 20 at the unfolded position and to place the smoking substance in the substance chamber 211 of the crucible unit 21. Then, by depressing the actuator 14, the lighter apparatus 10 will produce the flame at the flame opening 112 to burn the smoking substance. It is worth to mention that the flame opening 112 is formed at the housing sidewall 111 of the lighter housing 10 such that the flame nozzle 13 is longitudinally supported at the lighter housing 11 to produce the flame at the longitudinal direction of the lighter housing 10 so as to enhance the windproof ability of the flame. Once the smoking substance is burnt to generate the smoke, the smoker is able to inhale the smoke through the inhaler apparatus 20 instantly. Accordingly, a covering cap 23 is provided to removably cover at the substance chamber 211 of the crucible unit 21 when the pipe lighter is not in use.

The advantage of the present embodiment is its portability. The tobacco or other substance pipe and lighter are all contained in a single unit, such that there is only one item need to be carried.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A lighter, comprising:

a lighter apparatus which comprises a lighter housing having a housing sidewall, a flame opening provided at said housing sidewall, and a fuel storage chamber for storing liquefied gas therewithin, an ignition unit supported within said lighter housing, a flame nozzle operatively extended from said fuel storage chamber to said flame opening for releasing said gas in a controllable manner, and an actuator which is movably supported on said lighter housing and is arranged in such a manner that when said actuator is depressed, said gas in said fuel storage chamber is released towards said flame nozzle while said ignition unit is activated for igniting said gas at said flame nozzle so as to produce a flame through said flame opening; and an inhaler apparatus which comprises a crucible unit coupled with said housing sidewall of said lighter housing and a tubular inhaling guider extended from said crucible unit, wherein said crucible unit has a substance chamber positioned adjacent to said flame opening of said lighter housing for retaining a smoking substance in said substance chamber, such that said lighter apparatus is actuated to produce said flame for a combustion of said smoking substance to be smoked and for an inhalation of said smoked through said inhaling guider, wherein said crucible unit has a coupling sidewall pivotally coupling with said housing sidewall of said lighter housing to enable said inhaler apparatus to pivotally move between a folded position that said flame opening is covered by said coupling sidewall of said crucible unit for preventing said flame being produced at said flame opening, and an unfolded position that said crucible unit is pivotally folded until said substance chamber thereof is positioned adjacent to said flame opening of said lighter housing, wherein said inhaling guider has a mouth-piece end, an opposed coupling end coupling with said crucible unit, and an inhaler channel extended from said coupling end to said mouth-piece end to communicate with said substance chamber for an inhalation of said smoked through said inhaling guider.

2. The lighter, as recited in claim 1, wherein said coupling end of said inhaling guider is detachably coupled with said crucible unit.

3. The lighter, as recited in claim 2, further comprising a side housing sidewardly and integrally extended from said housing sidewall of said lighter housing, wherein said side housing has a top wall and a front wall arranged in such a manner that when said inhaler apparatus is pivotally folded at said folded position, said inhaling guider is folded to overlay on said front wall of said side housing, and when said inhaler apparatus is pivotally folded at said unfolded position, said crucible unit is folded to overlay on said top wall of said side housing, such that said front wall and said top said inhaler apparatus between said folded and unfolded positions.

4. The lighter, as recited in claim 3, wherein said lighter housing further has a plurality of ventilating holes spacedly formed on said housing sidewall of said lighter housing to communicate with an interior thereof for enhancing an air circulation of said lighter housing when said lighter apparatus is actuated for ignition.

5. The lighter, as recited in claim 3, wherein said side housing has a substance compartment formed at said front wall for containing said smoking substance to be smoked within said substance compartment, and comprises a compartment cover pivotally coupled at said front wall to pivotally enclose said substance compartment.

6. The lighter, as recited in claim 5, wherein said lighter housing further has a plurality of ventilating holes spacedly formed on said housing sidewall of said lighter housing to communicate with an interior thereof for enhancing an air circulation of said lighter housing when said lighter apparatus is actuated for ignition.

7. The lighter, as recited in claim 5, wherein said side housing has a trapezoid shape that a cross-sectional area of said substance compartment is gradually reducing towards said top wall.

8. The lighter, as recited in claim 7, wherein said lighter housing further has a plurality of ventilating holes spacedly formed on said housing sidewall of said lighter housing to communicate with an interior thereof for enhancing an air circulation of said lighter housing when lighter apparatus is actuated for ignition.

9. The lighter, as recited in claim 7, wherein said inhaler apparatus is perpendicularly extended from said lighter apparatus when said inhaler apparatus is folded at said unfolded position, while said inhaler apparatus is parallely extended from said lighter apparatus to overlap said coupling sidewall with said housing sidewall when said inhaler apparatus is folded at said folded position so as to form a compact box-shaped structure.

10. The lighter, as recited in claim 9, wherein said lighter housing further has a plurality of ventilating holes spacedly formed on said housing sidewall of said lighter housing to communicate with an interior thereof for enhancing an air circulation of said lighter housing when said lighter apparatus is actuated for ignition.

11. The lighter, as recited in claim 1, further comprising a side housing sidewardly and integrally extended from said housing sidewall of said lighter housing, wherein said side housing has a top wall and a front wall arranged in such a manner that when said inhaler apparatus is pivotally folded at said folded position, said inhaling guider is folded to overlay on said front wall of said side housing, and when said inhaler apparatus is pivotally folded at said unfolded position, said crucible unit is folded to overlay on said top wall of said side housing, such that said front wall and said top wall of said side housing form as two folding guides for limiting a pivotal movement of said inhaler apparatus between said folded and infolded positions.

12. The lighter, as recited in claim 11, wherein said side housing has a substance compartment formed at said front wall for containing said smoking substance to be smoked within said substance compartment, and comprises a compartment cover pivotally coupled at said front wall to pivotally enclose said substance compartment.

13. The lighter, as recited in claim 12, wherein said side housing has a trapezoid shape that a cross-sectional area of said substance compartment is gradually reducing towards said top wall.

14. The lighter, as recited in claim 13, wherein said inhaler apparatus is perpendicularly extended from said lighter apparatus when said inhaler apparatus is folded at said unfolded position, while said inhaler apparatus is parallely extended from said lighter apparatus to overlap said coupling sidewall with said housing sidewall when said inhaler apparatus is folded at said folded position so as to form a compact box-shaped structure.

* * * * *